US005217541A

United States Patent [19]

Chin et al.

[11] Patent Number: 5,217,541

[45] Date of Patent: Jun. 8, 1993

[54] PERMANENT MAGNET AND THE METHOD FOR PRODUCING THE SAME

[75] Inventors: Tsung-Shune Chin, Hsinchu; Shiang-Jiun Heh, Taipei; Ken-Der Lin, Hsinchu, all of Taiwan

[73] Assignee: High End Metals Corp., Hsinchu, Taiwan

[21] Appl. No.: 752,895

[22] Filed: Aug. 26, 1991

Related U.S. Application Data

[63] Continuation-in-part of Ser. No. 518,564, May 3, 1990, abandoned.

[51] Int. Cl.[5] ..... H01F 1/02

[52] U.S. Cl. ..... 148/103; 148/104; 419/12; 419/13; 419/29; 419/57; 419/60

[58] Field of Search ..... 148/101, 103, 104; 419/12, 13, 29, 57, 60

[56] References Cited

U.S. PATENT DOCUMENTS

| | | | |
|---|---|---|---|
| 3,970,484 | 7/1976 | Doser | 148/103 |
| 4,601,875 | 7/1986 | Yamamoto et al. | 148/104 |
| 4,888,512 | 12/1989 | Shimizu | 148/104 |
| 4,902,357 | 2/1990 | Imaizumi | 148/101 |

FOREIGN PATENT DOCUMENTS

| | | | |
|---|---|---|---|
| 0190461 | 8/1986 | European Pat. Off. | 148/302 |
| 60-144906 | 7/1985 | Japan | 148/302 |
| 61-9551 | 1/1986 | Japan | 148/302 |

*Primary Examiner*—John P. Sheehan

*Attorney, Agent, or Firm*—Cushman, Darby & Cushman

[57] ABSTRACT

A permanent magnet essentially consisting of in weight percent, 60% to 68% at least one transition element by weight, 30% to 38% at least one rare earth element by weight, 0.1% to 1.5% nitrogen by weight, and 0.8% to 1.5% boron by weight is disclosed. A method for producing the permanent magnet containing at least one rear element, at least one rare earth element, nitrogen and boron includes melting, cooling, milling, magnetizing, and compacting the transition element, the rare earth element and boron to form a green compact, and then sintering the green compact in nitrogen atmosphere having a constant partial pressure for 1 to several hours to form the permanent magnet.

9 Claims, No Drawings

PERMANENT MAGNET AND THE METHOD FOR PRODUCING THE SAME

This is a continuation-in-part of application Ser. No. 07/518,564, filed on May 3, 1990, which was abandoned upon the filing hereof.

BACKGROUND OF THE INVENTION

This invention relates to a permanent magnet and the method for producing the same, more particularly to a permanent magnet which has high maximum energy product and good corrosion-resistance.

Since 1970s, rare earth type magnets have been widely used for motors, radios, etc. because their maximum energy product is 3 to 10 times of that of conventional magnets, which are made of, for example, Al-Ni-Co, Ba ferrite. Two types of rare earth permanent magnets, Sm-Co magnets and Nd-Fe-B magnets, have been proposed. Sm-Co magnet has good corrosion-resistance although its maximum energy product is comparatively lower (about 16 to 30 MGOe). Nd-Fe-B magnet has a high maximum energy product (over 25 MGOe), but it has a poor corrosion-resistance. In these cases, a rare earth permanent magnet cannot possess both a high maximum energy product and good corrosion-resistance.

In addition, because the rare earth elements are highly reactive, they are therefore liable to react with oxygen and nitrogen in the air, resulting in deterioration of the magnetism of the permanent magnet produced therefrom. Therefore, conventional rare earth magnets must be sintered in an inert gas, such as argon and helium during the manufacturing process. However, because the inert gas is expensive, the manufacturing cost of such permanent magnets is high. U.S. Pat. No. 3970484 discloses a method for producing a Sm-Co magnet including sintering the Sm-Co magnet in hydrogen atmosphere in order to reduce the manufacturing cost. However, it is very dangerous to use hydrogen gas at a high temperature during the sintering process.

SUMMARY OF THE INVENTION

It is therefore a main object of this invention to provide a permanent magnet which has high maximum energy product and good corrosion-resistance.

It is another object of this invention to provide a method for producing a permanent magnet containing ar least one rare earth element in a nitrogen atmosphere which is cost-effective and safe.

Accordingly, the permanent magnet of this invention essentially consists of at least one transition element, at least one rare earth element, nitrogen and boron, wherein the transition element is 60 to 68% by weight, the rare earth element is 30 to 38% by weight, nitrogen is 0.1 to 1.5% by weight and boron is 0.8 to 1.5% by weight based on the total weight per unit of the permanent magnet.

The method of producing a permanent magnet of this invention includes melting, cooling, milling, magnetizing, and compacting a least one transition element, a least one rare earth element and boron at a predetermined ratio to form a green compact, and then sintering the green compact in a nitrogen atmosphere having a constant partial pressure for 1 to several hours in order to form the permanent magnet.

DETAILED DESCRIPTION OF THE PREFERRED EMBODIMENT

Other features and advantages of this invention will become apparent in the following detailed description of a preferred embodiment of this invention with reference to the experimental data.

In accordance with the present invention, a permanent magnet essentially consists of transition elements, rare earth elements, nitrogen and boron, wherein the transition elements are 60 to 68% by weight, the rare earth elements are 30 to 38% by weight, nitrogen is 0.1 to 1.5% by weight and boron is 0.8 to 1.5% by weight based on the total weight per unit of the permanent magnet.

The transition elements essentially contains iron. However, other transition elements can be added to the iron. For example, cobalt can be added to increase the Curie temperature of the permanent magnet. The weight percentage of added cobalt can be up to 15 while the weight percentage of iron and cobalt remains 60 to 68. In addition, aluminium can be added to the iron so as to increase the intrinsic coercivity of the permanent magnet.

The rare earth elements essentially contains neodymium. However, other rare earth elements can be added to the neodymium. For example, dysprosium is added to the neodymium to increase the intrinsic coercivity of the magnet. The weight percentage of the dysprosium added can be up to 5 while the weight percent of neodymium and dysprosium remains 30 to 38. Because cerium is cheaper than neodymium, cerium may be added to the neodymium so as to reduce manufacturing costs. The weight percentage of the added cerium can be up to 10.

Nitrogen increases the corrosion-resistance of the permanent magnet. The more nitrogen is contained in the permanent magnet, the better the corrosion-resistance. However, the amount of nitrogen should not exceed 1.5% by weight based on the total weight of the permanent magnet. When the amount of nitrogen exceeds 1.5% by weight, the magnetism of the permanent magnet will be significantly deteriorated. In general, the amount of nitrogen is preferably 1.2% to 1.3% by weight so that the permanent magnet can exhibit a good corrosion-resistance without deterioration of its magnetism.

The permanent magnet of this invention is produced by a method which will be described herein. At least one transition element, at least one rare earth element, and boron are melted in vacuum or proper amount of argon or nitrogen gas at 1400 degrees centigrade in a vacuum induction furnace to form a molten solution. Thereafter, the molten solution is poured on a copper plate which is cooled by water so as to form an alloy chunk. The alloy chunk is crushed into rough powder, one grain of which is smaller than 100 microns in diameter. The rough power is then milled into to a fine alloy powder having a grain diameter of 2 to 6 microns by using a nitrogen gas stream with a pressure above 6 atm which forces grains of said rough powder to collide with on another in a jet mill or by ball-milling. The fine powder is compacted in a metal die under the protection of nitrogen gas in a orientation magnetic field of 8000 to 15000 Oe parallel to the direction of compaction, at a pressure of 1.5 to 3 tons/cm$^2$. The green compact is then placed in a vacuum furnace and sintered at a temperature of 1000 to 1100 degree centigrade, preferably 1040 to 1050 degree centigrade, for 1 to several hours. Before placing the green compact in the vacuum furnace, the pressure in the vacuum furnace is lowered to 0.000001 torr to remove oxygen which will deteriorate the magnetism of the permanent magnet and the vacuum furnace is then filled with nitrogen gas to maintain a partial pressure 0.01 torr. During sintering, the partial pressure of the nitrogen gas may be increased to 100 to 300 torr at one time, so that the nitrogen atoms can combine with the transition elements and the rare earth elements. However, this step can be omitted. After sintering, the resulting permanent magnet is heated at different temperatures ranging from 500 to 900 degree centigrade for 1 to several hours so as to increase the intrinsic coercivity of the permanent magnet.

Ten permanent magnets with different compositions of this invention are shown in Table 1.

TABLE 1

| | Transition element(s) | | | Rare earth element(s) | | | Nitrogen | Boron |
|---|---|---|---|---|---|---|---|---|
| Sample | Fe | Co | Al | Nd | Dy | Ce | N | B |
| 1 | — | x | x | 31.4 | x | x | 0.43 | 1.0 |
| 2 | — | x | 0.6 | 32.5 | x | x | 0.22 | 0.9 |
| 3 | — | x | x | 28 | x | 5 | 0.8 | 1.0 |
| 4 | — | x | 0.6 | 29 | 4 | x | 1.2 | 0.8 |
| 5 | — | 15 | 0.5 | 34 | x | x | 0.6 | 1.5 |
| 6 | — | x | x | 30.5 | x | 5 | 2.7 | 1.3 |
| 7 | — | 9 | 0.84 | 35.5 | x | x | 0.6 | 1.2 |
| 8 | — | x | x | 33.7 | 2.7 | x | 0.4 | 1.2 |
| 9 | — | x | x | 32 | 4.5 | x | 0.8 | 1.0 |
| 10 | — | x | x | 37.2 | x | x | 1.3 | 1.2 |

wherein "-" represents "balance" and the compositions of the permanent magnets are represented in percentage by weight of the respective permanent magnets.

The magnetic properties test results of the abovementioned permanent magnets are shown in Table 2.

TABLE 2

| Sample | Remanence (KG) | Coercivity (KOe) | Intrinsic coercivity (KOe) | Maximum energy product (MGOe) |
|---|---|---|---|---|
| 1 | 11.9 | 6.3 | 6.6 | 24.5 |
| 2 | 11.5 | 9.6 | 12.0 | 30.5 |
| 3 | 10.8 | 7.6 | 10.1 | 24.5 |
| 4 | 11.3 | 10.8 | 18.0 | 31.0 |
| 5 | 10.9 | 8.8 | 11.2 | 26.0 |
| 6 | 10.2 | — | — | — |
| 7 | 10.8 | 8.0 | 8.4 | 25.0 |
| 8 | 10.9 | 10.8 | 18.4 | 29.0 |
| 9 | 10.6 | 9.5 | 18.6 | 26.0 |
| 10 | 11.3 | 6.5 | 7.2 | 27.0 |

It can be seen from Table 2 that the maximum energy product of the permanent magnet of this invention is maintained at value of about 25 to 36 MGOe which is larger than that of the conventional Sm-Co magnet (16 to 30 MGOe) and generally equals that of the Nd-Fe-B magnet (greater than 25 MGOe). In addition, it is seen from Table 1 and Table 2 that when the nitrogen content exceeds 1.5% by weight for example, Sample 6, the magnetism is deteriorated and therefore the maximum energy product, intrinsic coercivity, etc. are significantly and adversely affected. Hence, the nitrogen content must be kept below 1.5% by weight to obtain the best magnetism.

To test the corrosion-resistance, a Tm-Re-N-B magnet of this invention, a Nd-Fe-B magnet and a Sm-Co magnet are placed in hydrochloric acid solution of 5% by weight and kept still at room temperature (28 degree centigrade) for 30 minutes. Thereafter, the weigh loss is measured. The average values of 3 to 5 trials of weight measurement are shown in Table 3.

TABLE 3

| Magnet | Tm—Re—N—B | Nd—Fe—B | Sm—Co |
|---|---|---|---|
| Weight loss, % | 15 | 20 | 12 |
| Nitrogen content, % | 1.2 | — | — |

It can be seen from Table 3 that the weight loss of the Tm-Re-N-B magnet is less than that of Nd-Fe-B magnet and greater than that of Sm-Co magnet. That is to say, the corrosion-resistance of the magnet of this invention is better than that of Nd-Fe-B magnet and slightly poorer than that of Sm-Co magnet. However, the maximum energy product of the magnet of this invention is greater than that of the Sm-Co magnet. Therefore, the permanent magnet of this invention can both possess higher maximum energy product and good corrosion-resistance.

Furthermore, the permanent magnet of this invention can be sintered in nitrogen atmosphere, instead of in inert atmosphere or hydrogen atmosphere. Therefore, the method for producing the permanent magnet of this invention is cost-effective and safe.

With this invention thus explained, it is apparent that numerous modifications and variations can be made without departing from the scope and spirit of this invention. It is therefore intended that this invention be limited only as indicated in the appended claims.

We claim:

1. A method for producing a permanent magnet essentially consisting of at least one transition element, at least one rare earth element and boron, said method comprising the steps of:

(1) combining and melting at least one transition element, at least one rare earth element and boron to form a molten solution;

(2) cooling said molten solution to form an alloy chunk;

(3) milling said alloy chunk to an alloy powder having a grain diameter of 2 to 6 microns;

(4) compacting said alloy powder in a first nitrogen atmosphere in a metal die in a magnetic field to form a green compact; and (5) sintering said green compact in a second nitrogen atmosphere at 1000 to 1100 degree centigrade for at least one hour to form said permanent magnet, the partial pressure of said second nitrogen atmosphere being maintained at a pressure of about 0.1 torr.

2. A method as claimed in claim 1 further comprising heat treating said permanent magnet after step (5).

3. A method as claimed in claim 2, wherein said permanent magnet is heated at 500 to 900 degree centigrade.

4. A method as claimed in claim 1, wherein the partial pressure of said second nitrogen atmosphere is raised to 100 to 300 torr for a period of time.

5. A method as claimed in claim 4, wherein said green compact is sintered at a temperature of 1040 to 1050 degree centigrade.

6. A method as claimed in claim 1, wherein prior to said sintering step oxygen is removed from a vacuum furnace for said sintering step by lowering the vacuum furnace pressure to about 0.0000001 torr and then filling said vacuum furnace with nitrogen to a pressure of about 0.01 torr.

7. A method as claimed in claim 4, wherein said green compact is sintered for a period of time sufficient to allow said nitrogen atoms to combine with said at least one transition element and at least one rare earth element to a nitrogen content of below 1.5% by weight.

8. A method as claimed in claim 1, wherein the content of said at least one rare earth element is about 30 to 38 wt % based on the total weight of said permanent magnet and said at least one rare earth element is selected from the group consisting of Nd and Dy.

9. A method as claimed in claim 1, wherein said at least one transition element includes Fe and an element selected from the group consisting of Co and Al.

* * * * *